US008108147B1

(12) United States Patent
Blackburn

(10) Patent No.: US 8,108,147 B1
(45) Date of Patent: Jan. 31, 2012

(54) APPARATUS AND METHOD FOR AUTOMATIC OMNI-DIRECTIONAL VISUAL MOTION-BASED COLLISION AVOIDANCE

(75) Inventor: Michael Blackburn, Encinitas, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 470 days.

(21) Appl. No.: 12/366,757

(22) Filed: Feb. 6, 2009

(51) Int. Cl.
*G08G 1/16* (2006.01)

(52) U.S. Cl. ..... 701/301; 701/2; 701/21; 702/92; 73/1.38; 382/103; 382/104; 382/106; 382/154; 345/419; 345/505; 340/990; 340/995.14; 324/310; 235/454; 250/214.1; 250/330; 348/36; 348/148; 348/218.1; 356/5.08; 375/295

(58) Field of Classification Search ..... 701/2, 21, 701/301; 702/92; 73/1.38; 382/103, 104, 382/106, 154; 345/419, 505; 340/990, 995.14; 324/310; 235/454; 250/214.1, 330; 348/36, 348/148, 218.1; 356/5.08; 375/295
See application file for complete search history.

(56) References Cited

U.S. PATENT DOCUMENTS

| | | | | |
|---|---|---|---|---|
| 3,781,111 | A * | 12/1973 | Fletcher et al. | 356/5.08 |
| 5,317,689 | A * | 5/1994 | Nack et al. | 345/505 |
| 5,467,072 | A | 11/1995 | Michael | |
| 5,793,310 | A * | 8/1998 | Watanabe et al. | 340/995.14 |
| 5,867,536 | A * | 2/1999 | Lyons et al. | 375/295 |
| 6,859,731 | B2 | 2/2005 | Takafuji et al. | |
| 6,889,786 | B2 | 5/2005 | Watanabe et al. | |
| 7,016,783 | B2 | 3/2006 | Hac et al. | |
| 7,337,650 | B1 * | 3/2008 | Preston et al. | 73/1.38 |
| 7,647,180 | B2 * | 1/2010 | Breed | 701/301 |
| 7,703,679 | B1 * | 4/2010 | Bennetts et al. | 235/454 |
| 2002/0056806 | A1 * | 5/2002 | Bechtel et al. | 250/214.1 |
| 2004/0179099 | A1 * | 9/2004 | Bos et al. | 348/148 |
| 2004/0264763 | A1 * | 12/2004 | Mas et al. | 382/154 |
| 2006/0023074 | A1 * | 2/2006 | Cutler | 348/218.1 |
| 2006/0028542 | A1 * | 2/2006 | Rondinelli et al. | 348/36 |
| 2006/0072020 | A1 * | 4/2006 | McCutchen | 348/218.1 |

(Continued)

OTHER PUBLICATIONS

Fiorini, P. and Schiller, Z., Motion Planning in Dynamic Environments Using the Relative Velocity Paradigm, Journal, 1993, pp. 560-565, vol. I, Proceedings of the IEEE International Conference on Automation.

(Continued)

*Primary Examiner* — Mary Cheung
*Assistant Examiner* — Sanjeev Malhotra
(74) *Attorney, Agent, or Firm* — Arthur K. Samora; Kyle Eppele

(57) ABSTRACT

A method of identifying and imaging a high risk collision object relative to a host vehicle includes arranging a plurality of N sensors for imaging a three-hundred and sixty degree horizontal field of view (hFOV) around the host vehicle. The sensors are mounted to a vehicle in a circular arrangement so that the sensors are radially equiangular from each other. For each sensor, contrast differences in the hFOV are used to identify a unique source of motion (hot spot) that is indicative of a remote object in the sensor hFOV. A first hot spot in one sensor hFOV is correlated to a second hot spot in another hFOV of at least one other N sensor to yield range, azimuth and trajectory data for said object. The processor then assesses a collision risk with the object according to the object's trajectory data relative to the host vehicle.

13 Claims, 7 Drawing Sheets

U.S. PATENT DOCUMENTS

| | | | | |
|---|---|---|---|---|
| 2006/0081778 | A1* | 4/2006 | Warner et al. | 250/330 |
| 2007/0064976 | A1* | 3/2007 | England, III | 382/106 |
| 2007/0165910 | A1* | 7/2007 | Nagaoka et al. | 382/104 |
| 2008/0027591 | A1* | 1/2008 | Lenser et al. | 701/2 |
| 2008/0071492 | A1* | 3/2008 | Skvortsov et al. | 702/92 |
| 2009/0140887 | A1* | 6/2009 | Breed et al. | 340/990 |
| 2009/0226033 | A1* | 9/2009 | Sefcik | 382/103 |
| 2009/0271054 | A1* | 10/2009 | Dokken | 701/21 |
| 2009/0276105 | A1* | 11/2009 | Lacaze et al. | 701/2 |
| 2010/0039110 | A1* | 2/2010 | Takahashi et al. | 324/310 |
| 2010/0045666 | A1* | 2/2010 | Kornmann et al. | 345/419 |
| 2010/0172542 | A1* | 7/2010 | Stein et al. | 382/103 |

OTHER PUBLICATIONS

Fiorini, P. and Schiller, Z., Motion Planning in Dynamic Environments Using Velocity Obstacles, Journal, 1998, pp. 760-772, vol. 17, International Journal of Robotics Research.

Yung N,H,C, and Ye, C., Avoidance of Moving Obstacles Through Behavior Fusion and Motion Prediction, Journal, 1998, pp. 3424-3429, Proceedings of IEEE International Conference on Systems, Man, and Cybernetics, San Diego, California.

Fujimori, A. and Tani, S., A Navigation of Mobile Robots with Collision Avoidance for Moving Obstacles, Journal, 2002, pp. 1-6, IEEE ICIT '02, Bangkok, Thailand.

Blackburn, M.R., H.G. Nguyen, and P.K. Kaomea, "Machine Visual Motion Detection Modeled on Vertebrate Retina," SPIE Proc. 980: Underwater Imaging, San Diego, CA; pp. 90-98 (1988).

Blackburn, M.R. and H.G. Nguyen, "Vision Based Autonomous Robot Navigation: Motion Segmentation", Proceedings for the Dedicated Conference on Robotics, Motion, and Machine Vision in the Automotive Industries. 28th ISATA, Sep. 18-22, 1995, Stuttgart, Germany, 353-360.

Blackburn, M.R., U.S. Appl. No. 12/144,019, entitled "A Method for Determining Collision Risk for Collision Avoidance Systems", filed Jun. 23, 2008.

Blackburn, M.R., U.S. Appl. No. 12/145,670, entitled "Host-Centric Method for Automobile Collision Avoidance Decisions", filed Jun. 25, 2008.

* cited by examiner

APPARATUS AND METHOD FOR AUTOMATIC OMNI-DIRECTIONAL VISUAL MOTION-BASED COLLISION AVOIDANCE

FEDERALLY-SPONSORED RESEARCH AND DEVELOPMENT

This subject matter (Navy Case No. 98,834) was developed with funds from the United States Department of the Navy. Licensing inquiries may be directed to Office of Research and Technical Applications, Space and Naval Warfare Systems Center, San Diego, Code 2112, San Diego, Calif., 92152; telephone (619) 553-2778; email: T2@spawar.navy.mil.

FIELD OF THE INVENTION

The present invention applies to devices for providing an improved mechanism for automatic collision avoidance, which is based on processing of visual motion from a structured array of vision sensors.

BACKGROUND OF THE INVENTION

Prior art automobile collision avoidance systems commonly depend upon Radio Detection and Ranging ("RADAR") or Light Detection and Ranging ("LIDAR") to detect and determine object range and azimuth of a foreign object relative to a host vehicle. The commercial use of these two sensors is currently limited to a narrow field of view in advance of the automobile. Preferred comprehensive collision avoidance is 360-degree awareness of objects, moving or stationary, and prior art discloses RADAR and LIDAR approaches to 360-degree coverage.

The potential disadvantages of 360-degree RADAR and LIDAR are expense, and the emission of energy into the environment. The emission of energy would become a problem when many systems simultaneously attempt to probe the environment and mutually interfere, as should be expected if automatic collision avoidance becomes popular. Lower frequency, longer wavelength radio frequency (RF) sensors such as RADAR suffer additionally from lower range and azimuth resolution, and lower update rates compared to the requirements for 360-degree automobile collision avoidance. Phased-array RADAR could potentially overcome some of the limitations of conventional rotating antenna RADAR but is as yet prohibitively expensive for commercial automobile applications.

Visible light sensors offer greater resolution than lower frequency RADAR, but this potential is dependent upon adequate sensor focal plane pixel density and adequate image processing capabilities. The focal plane is the sensor's receptor surface upon which an image is focused by a lens. Prior art passive machine vision systems used in collision avoidance systems do not emit energy and thus avoid the problem of interference, although object-emitted or reflected light is still required. Passive vision systems are also relatively inexpensive compared to RADAR and LIDAR, but single camera systems have the disadvantage of range indeterminacy and a relatively narrow field of view. However, there is but one and only one trajectory of an object in the external volume sensed by two cameras that generates any specific pattern set in the two cameras simultaneously. Thus, binocular registration of images can be used to de-confound object range and azimuth.

Multiple camera systems in sufficient quantity can provide 360-degree coverage of the host vehicle's environment and, with overlapping fields of view can provide information necessary to determine range. U.S. Patent Application Publication No. 2004/0246333 discloses such a configuration. However, the required and available vision analyses for range determination from stereo pairs of cameras depend upon solutions to the correspondence problem. The correspondence problem is a difficulty in identifying the points on one focal plane projection from one camera that correspond to the points on another focal plane projection from another camera.

One common approach to solving the correspondence problem is statistical, in which multiple analyses of the feature space are made to find the strongest correlations of features between the two projections. The statistical approach is computationally expensive for a two camera system. This expense would only be multiplied by the number of cameras required for 360-degree coverage. Camera motion and object motion offer additional challenges to the determination of depth from stereo machine vision as object image features and focal plane projection locations are changing over time. In collision avoidance, however, the relative movement of objects is a key consideration, and thus should figure principally in the selection of objects of interest for the assessment of collision risk, and in the determination of avoidance maneuvers. A machine vision system based on motion analysis from an array of overlapping high-pixel density vision sensors, could thus directly provide the most relevant information, and could simplify the computations required to assess the ranges, azimuths, elevations, and behaviors of objects, both moving and stationary about a moving host vehicle.

The present subject matter overcomes all of the above disadvantages of prior art by providing an inexpensive means for accurate object location determination for 360 degrees about a host vehicle using a machine vision system composed of an array of overlapping vision sensors and visual motion-based object detection, ranging, and avoidance.

SUMMARY OF THE INVENTION

A method of identifying and imaging a high risk collision object relative to a host vehicle according to one embodiment of the invention includes the step of arranging a plurality of N high-resolution limited-field-of-view sensors for imaging a three-hundred and sixty degree horizontal field of view (hFOV) around the host vehicle. In one embodiment, the sensors are mounted to a vehicle in a circular arrangement and so that the sensors are radially equiangular from each other. In one embodiment of the invention, the sensors can be arranged so that the sensor hFOV's may overlap to provide coverage by more than one sensor for most locations around the vehicle. The sensors can be visible light cameras, or alternatively, infrared (IR) sensors.

The methods of one embodiment of the present invention further includes the step of comparing contrast differences in each camera focal plane to identify a unique source of motion (hot spot) that is indicative of a remote object that is seen in the field of view of the sensor. For the methods of the present invention, a first hot spot in one sensor focal plane is correlated to a second hot spot in another focal plane of at least one other of N sensors to yield range, azimuth and trajectory data for said object. The sensors may be immediately adjacent to each other, or they may be further apart; more than two sensors may also have a hot spot that correlate to the same object, depending on the number N of sensors used in the sensor array and the hFOV of the sensors.

The hot spots are correlated by a central processor to yield range and trajectory data for each located object. The processor then assesses a collision risk with the object according to the object's trajectory relative to the host vehicle. In one embodiment of the invention, the apparatus and methods accomplish a pre-planned maneuver or activates and audible or visual alarm, as desired by the user.

BRIEF DESCRIPTION OF THE DRAWINGS

The novel features of the present invention will be best understood from the accompanying drawings, taken in conjunction with the accompanying description, in which similarly-referenced characters refer to similarly referenced parts, and in which.

DETAILED WRITTEN DESCRIPTION

Figure 1:
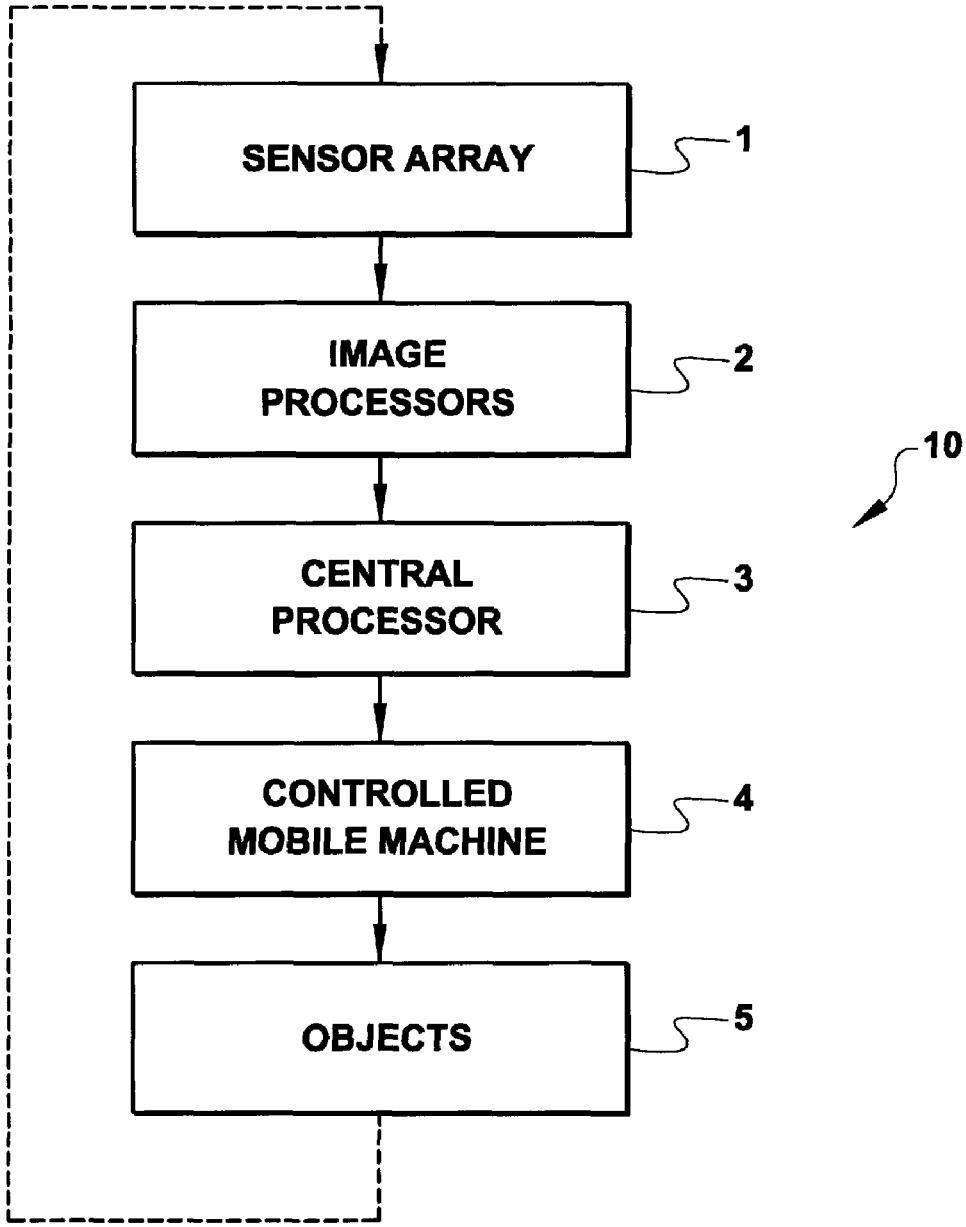
FIG. 1 shows a general overall architecture of a collision avoidance apparatus in accordance with the present invention.

The overall architecture of this collision avoidance method and apparatus is shown in FIG. 1. The machine visual motion-based object avoidance apparatus 10 is composed of four principal parts: sensor array 1, peripheral image processors 2, central processor 3, and controlled mobile machine 4 (referred to alternatively as "host vehicle"). Information is generated by detection by the sensor array 1 of objects 5 that are located in the environment of the controlled mobile machine 4, and flows in a loop through the system parts 1, 2, 3, and 4, contributing more or less to the motion of the machine 4, altering more or less its orientation with respect to the objects 5, and producing new information for detection at sensor array 1 at predetermined time intervals, all in a manner more fully described hereinafter.

Sensor array 1 provides for the passive detection of emissions and reflections of ambient light from remotely-located objects 5 in the environment. The frequency of these photons may vary from infrared (IR) through the visible part of the spectrum, depending upon the type and design of the detectors employed. In one embodiment of the invention, high definition video cameras can be used for the array. It should be appreciated, however, that other passive sensors could be used in the present invention for detection of remote objects.

An array of N sensors, which for the sake of this discussion are referred to as video cameras, are affixed to a host vehicle so as to provide 360-degree coverage of a volume around host vehicle 4. Host vehicle 4 moves through the environment, and/or objects 5 in the environment move such that relative motion between vehicle 4 and object 5 is sensed by two or more video cameras 12 (See FIG. 2) in sensor array 1. The outputs of the cameras are distributed to image processors 2.

In one embodiment, each video camera 12 can have a corresponding processor 2, so that outputs from each video camera are processed in parallel by a respective processor 2. Alternatively, one or more buffered high speed digital processors may receive and analyze the outputs of one or more cameras serially.

The optic flow (the perceived visual motion of objects by the camera due to the relative motion between object 5 and cameras 12 in sensor array 1 (FIG. 2) is analyzed by the image processors 2 for X and Y normal flow vectors. The X and Y normal flow vectors are the rates and directions of change in the position of contrast borders on the X (horizontal) axis and Y (vertical) axis of the focal plane. Further processing by image processors 2 yields the normal flow vectors for unique and salient motion within the visual field of view of each camera. The outputs of the image processors 2 are the respective focal plane coordinates of the unique and salient visual motion of objects 5 detected within the visual field of view of each camera, termed hereafter as hot-spots. These outputs are sent in parallel to central processor 3. The central processor 3 compares the coordinates of the hot-spots between groups of cameras with common overlapping visual hemi fields and calculates estimates of object range, azimuth, and elevation, and the process is repeated at predetermined intervals according that are selected by the user according using factors such as traffic environment maneuverability of vehicle 4, etc. The central processor 3 then estimates object trajectories and assesses the object 5 collision risk with the host vehicle 4 using the methods described in U.S. patent application Ser. No. 12/144,019, for an invention by Michael Blackburn entitled "A Method for Determining Collision Risk for Collision Avoidance Systems", which is hereby incorporated by reference. If collision risk is determined to be low for all sources, no avoidance response output is generated by central processor 3. Otherwise, central processor 3 determines a collision avoidance response based on the vector sum of all detected objects 5, and orders collision avoidance execution through the control apparatus of the host vehicle 4, if permitted by the human operator in advance.

In one embodiment, the avoidance response is determined in accordance with the methods described in U.S. patent application Ser. No. 12/145,670 by Michael Blackburn for an invention entitled "Host-Centric Method for Automobile Collision Avoidance Decisions", which is hereby incorporated by reference. Both of the '019 and '670 applications have the same inventorship as this patent application, as well as the same assignee, the U.S. Government, as represented by the Secretary of the Navy. As cited in the '670 application, for an automobile or unmanned ground vehicle (UGV), the control options may include modification of the host vehicle's acceleration, turning, and braking.

During all maneuvers of the host vehicle, the process is continuously active, and information flows continuously through 1-4 of apparatus 10 in the presence of objects 5, thereby involving the control processes of the host vehicle 4 as necessary.

Figure 2:
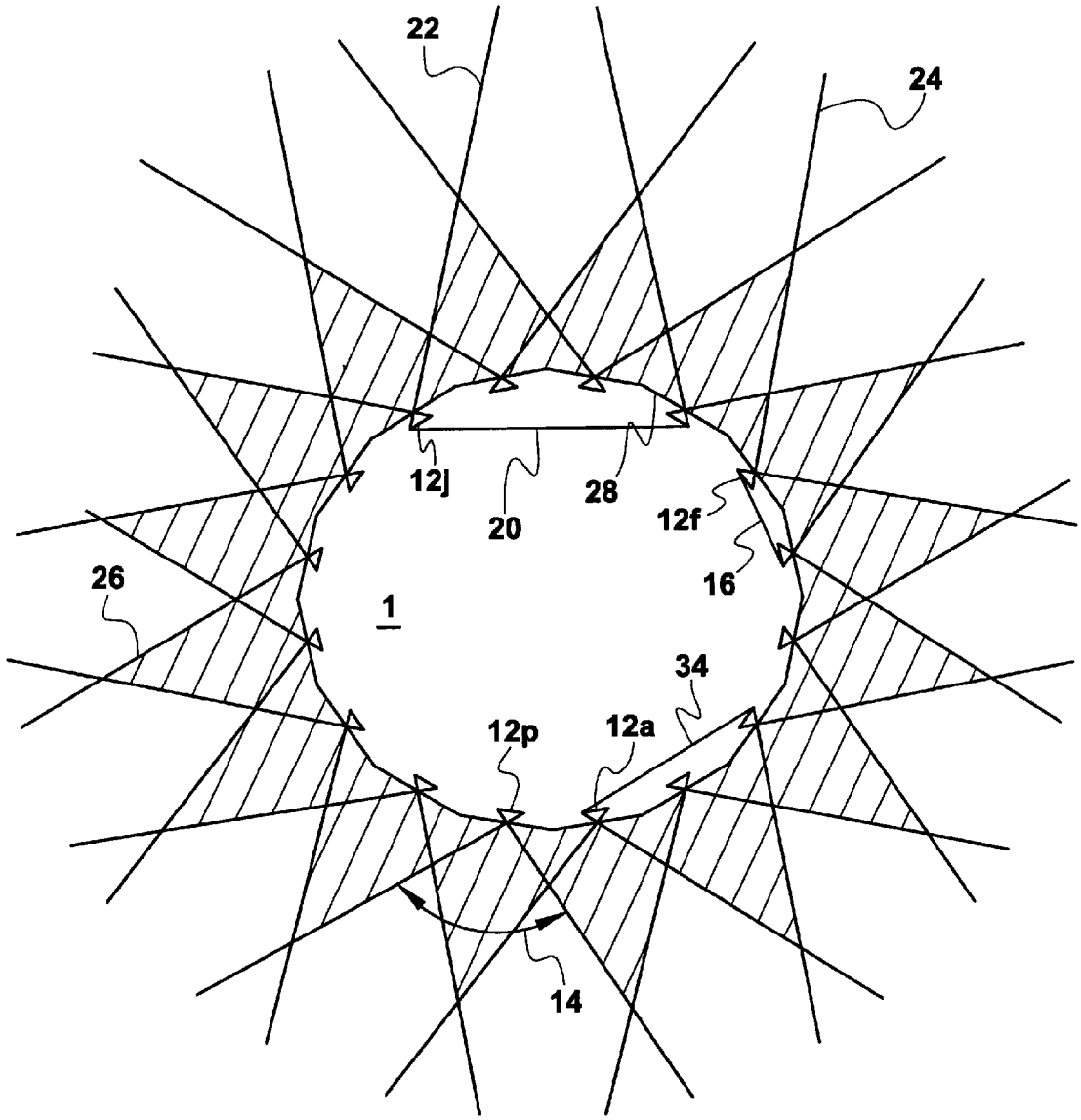
FIG. 2 depicts one orientation of video cameras for the sensor array shown in FIG. 1.

Referring now to FIG. 2, the sensor array 1 is shown in more detail. As shown in FIG. 2, sensor array 1 is composed of a plurality of N video cameras 12 with a horizontal field of view (hFOV) such that $hFOV/2 \gg \pi/N$ radians. For the embodiment shown in FIG. 2, N=16, cameras 12 each have a $hFOV/2=\pi/4$, which is greater than $\pi/16$. One such orientation of video cameras 12 is shown in FIG. 2, where a plurality of video cameras, of which cameras 12*a*-12*p* are representative, is arranged around circular frame 28 to ensure a three hundred and sixty (360) degree hFOV coverage around vehicle 4. Each camera 12 has a horizontal field of view (hFOV) of ninety degrees, or $\pi/2$ radians (hFOV=$\pi/2$ radians). The $\pi/2$ radian (90 degree) hFOV's are indicated by angle 14 in FIG. 2.

Figure 3:
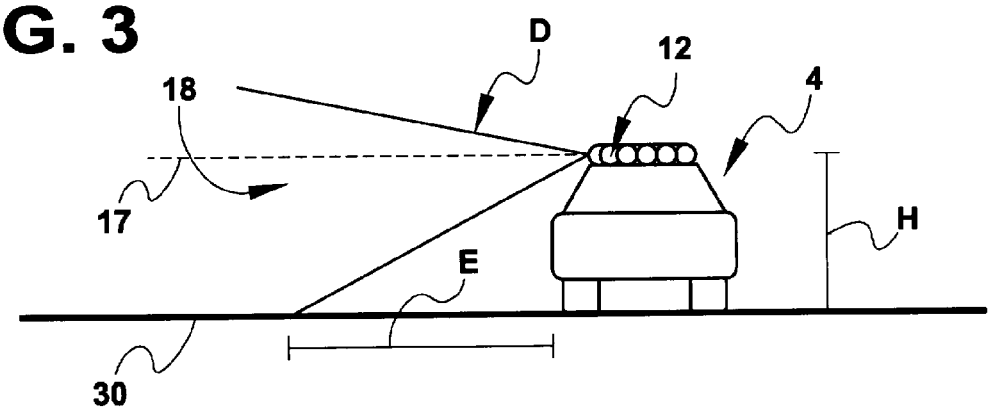
FIG. 3 is a front elevational view which shows one example arrangement of the sensor array and vehicle of FIG. 1.

Additionally, each camera 12 has a vertical field of view (vFOV) 18, see FIG. 3, of $\pi/4$ radians, a frame rate of 30 Hz or better, and a pixel resolution of 1024×780 (1024 horizontal×780 vertical pixels, or a 0.8 megapixel camera) or better in equidistant fixed locations about the circumference of a circular frame 28. With N cameras, the center of focus of each camera is $2\pi/N$ radians displaced from those of its two nearest neighbor cameras 12. With 16 cameras the displacement is $\pi/8$ radians between adjacent centers of focus.

Figure 4:
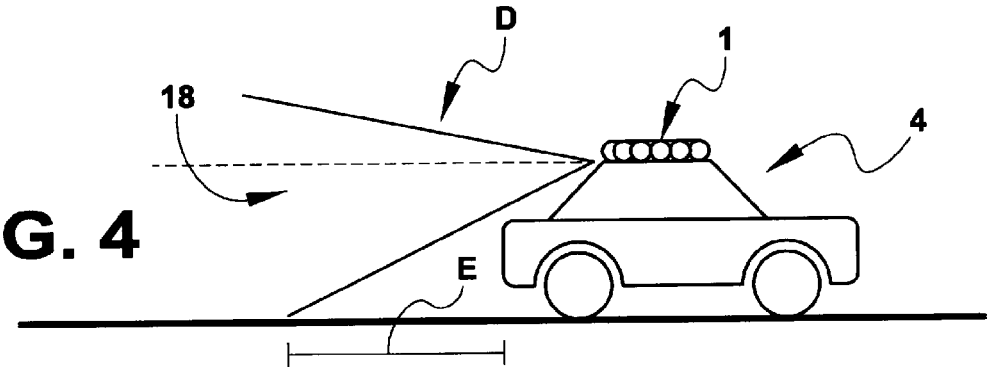
FIG. 4 shows is a side elevational view of the arrangement if FIG. 3.
Figure 5:
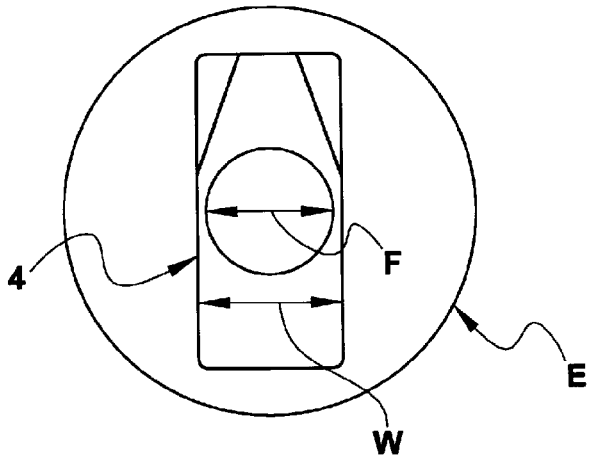
FIG. 5 is a top plan view of the arrangement of FIG. 3, which illustrates the overall coverage of the sensors.

FIGS. 3-5 illustrate an exemplary location of array 1 on vehicle 4. As shown is FIGS. 3-5, sensor array 1 can be mounted in a fixed position on the rotational center of the moving host vehicle 4, parallel to the travel plane of the host vehicle 4, such that video cameras 12 are able to scan, unobstructed, the travel plane 30 on which the host vehicle 4 moves. As shown in FIG. 5, diameter F of the sensor array 1 should approximate the maximum width W of host vehicle 4 on which it is attached.

As shown in FIGS. 3 and 4, the degree of tilt of the individual cameras 12 in sensor array 1 is dependent upon the magnitude of the vFOV 18 and upon the desired perspective with respect to the vehicle 4. More specifically, the tilt of each camera 12 can be fixed to be negative with respect to a plane 17 that is co-planar with sensor array 1 so that a greater part of the vFOV 18 covers the road plane 30. The portion of the vFOV that remains sensitive to activity above the plane 17 of the sensor array permits an assessment of the driving clearance above the height H of vehicle 4.

For the embodiment of the present invention shown in FIGS. 3 and 4, greater road coverage is achieved with a camera tilt of −18 degrees (−0.3142 radians) from the horizontal plane. With a vFOV of 45 degrees and a camera tilt of −18 degrees, the residual above horizontal plane 17 would be approximately 4.5 degrees. A frontal view of the host vehicle with the camera perspective is shown in FIG. 3, a side view is shown in FIG. 4 and a top plan view of vehicle 4 is shown in FIG. 5. In FIGS. 3-5, E is the range from vehicle 4 at which the vFOV intersects the ground plane 16; it is also the minimum range at which objects with negative elevation with respect to ground plane (i.e., ditches and pot holes) can be assessed, and D is the maximum elevation from plane 17 at which objects 5 can be assessed by cameras 12 (i.e., D is the upper bound of vFOV 18). At distances beyond minimum range E, all objects exhibiting motion relative to vehicle 4 within vFOV 18 can be detected and assessed for range, azimuth, and elevation. Thus, minimum and maximum ranges are a function of the tilt angle of the cameras 12, of the camera vFOV 18 and of the camera resolution, all of which can be pre-selected according to user needs.

By referring back to FIG. 2, it can be seen that except for a corona-shaped volume (denoted by 26) surrounding the frame 28, the maximum extent of which is a function of the separation of the cameras 12 on the perimeter of the sensor array 1, each point in the entire visual space surrounding the vehicle 4 is covered by the hFOV 14 of two or more cameras 12. With N=16, and individual camera hFOV=90 degrees, the largest number of cameras overlapping any particular point in the combined 360 degree field of view will be four. This is because overlap of the fields of view of any two cameras is a function of the average angle of their hFOV and orientation difference, which is based on the number N of cameras 12 in array 1). Another way to predict overlap is to note that 16×90=1440, while 1440/360=4. Of interest also is the question of the possibility of using cameras with narrower hFOV, say 60 degrees. To accomplish a similar coverage with cameras having a 60 degree hFOV, 24 cameras would be required (1440/60=24). When the orientation difference is equal to or greater than their average hFOV, overlap becomes impossible. When the average hFOV of any two cameras is 90 degrees, and the orientation difference increases with rotation about the frame by 22.5 degrees, by the fourth camera out the rotation has accumulated to 4×22.5 degrees, or 90 degrees, and overlap of additional cameras is no longer possible. Graphically, this is shown by hFOV limits 22 and 24 in FIG. 2, which are parallel. The parallel lines represent the limits of the hFOV of cameras 12*j* and 12*f*, respectively.

Prior art provides several methods of video motion analysis. One method that could be used herein emulates biological vision, and is fully described in Blackburn, M. R., H. G. Nguyen, and P. K. Kaomea, "Machine Visual Motion Detection Modeled on Vertebrate Retina," SPIE Proc. 980: Underwater Imaging, San Diego, Calif.; pp. 90-98 (1988). Motion analyses using this technique may be performed on sequential images in color, in gray scale, or in combination. For simplicity of this disclosure, only processing of the gray scale is described further. The output of each video camera is distributed directly to its image processor 2. The image processor 2 performs the following steps as described herein to accomplish the motion analysis:

First, any differences in contrast between the last observed image cycle and the present time frame are evaluated and preserved in a difference measure element. Each difference measure element maps uniquely to a pixel on the focal plane. Any differences in contrast indicate motion.

Next, the differences in contrast are integrated into local overlapping receptive fields. A receptive field, encompassing a plurality of difference measures, maps to a small-diameter local region of the focal plane, which is divided into multiple receptive fields of uniform dimension. There is one output element for each receptive field. Four receptive fields always overlap each difference measure element, thus four output elements will always be active for any one active difference measure element. The degree of activation of each of the four overlapping output elements is a function of the distance of the active difference element from the center of the receptive field of the output element. In this way, the original location of the active pixel is encoded in the magnitudes of the output elements whose receptive fields encompass the active pixel.

For the next step of the image processing by image processor 2, orthogonal optic flow (motion) vectors are calculated. As activity flows across individual pixels on the focal plane, the magnitude of the potentials in the overlapping integrated elements shifts. To perform motion analysis in step 3, the potentials in the overlapping integrated elements are distributed to buffered elements over a specific distance on the four cardinal directions. This buffered activity persists over time, degrading at a constant rate. New integrated element activity is compared to this buffered activity along the different directions and if an increase in activity is noted, the difference is output as a measure of motion in that direction. For every integrated element at every time t there is a short history of movement in its direction from its cardinal points due to previous cycles of operation for the system. These motions are assessed by preserving the short time history of activity from its neighbors and feeding it laterally backward relative to the direction of movement of contrast borders on the receptor surface to inhibit the detection of motion in the reverse direction. The magnitude of the resultant activity is correlated with the velocity of the contrast changes on the X (horizontal) or Y (vertical) axes. Motion along the diagonal, for example, would be noted by equal magnitudes of activity on X and Y.

Larger but equivalent magnitudes would indicate greater velocities on the diagonal. After the orthogonal optic flow (motion) vectors described above are calculated, opposite motion vectors can be compared and contradictions can be resolved.

After the basic motion analysis is completed as described above, the image processors 2 calculate the most salient motion in the visual field. Motion segmentation is used to identify saliency. Prior art provides several methods of motion segmentation. One method that could be used herein is more fully described in Blackburn, M. R. and H. G. Nguyen, "Vision Based Autonomous Robot Navigation: Motion Segmentation", Proceedings for the Dedicated Conference on Robotics, Motion, and Machine Vision in the Automotive Industries. 28$^{th}$ ISATA, 18-22 Sep. 1995, Stuttgart, Germany, 353-360.

The process of motion segmentation involves a comparison of the motion vectors between local fields of the focal plane. The comparison employs center-surround interactions modeled on those found in mammalian vision systems. That is, the computational plane that represents the output of the motion analysis process above is reorganized into a plurality of new circumscribed fields. Each field defines a center when considered in comparison with the immediate surrounding fields. Center-surround comparisons are repeated across the entire receptive field. Center-surround motion comparisons are composed of two parts. First, attention to constant or expected motion is suppressed by similar motion fed forward across the plane from neighboring motion detectors whose activity was assessed over the last few time samples, and second, the resulting novel motion is compared with the sums of the activities of the same and opposite motion detectors in its local neighborhood. The sum of the same motion detectors within the neighborhood suppresses the output of the center while the sum of the opposite detectors within the neighborhood enhances it.

Finally, the resulting activities in the fields (centers) are compared and the fields with the greatest activities are deemed to be the "hot spots" for that camera 12 by its image processor 2.

Information available on each hot spot that results from the above described motion analysis process yields the X coordinate, Y coordinate, magnitude of X velocity, and magnitude of Y velocity for each hot spot.

In one embodiment, image processors 2 (See FIG. 1) can be a dedicated silicon-based video processing chip. This chip may be developed using resistive-capacitive micro-integrated circuits to implement in parallel the logical processes described above, and interfaced directly to the image transducer of the video focal plane. With large production volumes, the cost of this embodiment would be feasible. Alternatively, a field programmable gate array (FPGA) may be programmed to perform the same functions.

For each computation cycle, the central processor 3 (See FIG. 1) receives and buffers any and all coordinates of the hot-spots along with the identity of the detecting sensor, from the N peripheral image processors 2 (See FIG. 1).

Hot-spots are described for specific regions of the focal plane of each camera 12. The size of the regions specified, and their center locations in the focal plane, are optional, depending upon the performance requirements of the motion segmentation application, but for the purpose of the present examples, the size is specified as a half of the total focal plane of a camera, divided down the vertical midline of the focal plane, and their center locations are specified as the centers of each of the two hemi fields of the focal plane. To ensure correspondence between different sensors having overlapping fields of view, image processors 2 identify the hot-spots on each hemi-focal plane (hemi-field) independently of each other. As can be seen from the overlapping hFOV's in FIG. 2, neighboring cameras 12 can detect and segment the unique motions of object 5 in FIG. 1 and represent that object's coordinates in pairs of hemi-fields between from two to four cameras depending on the range, azimuth, and elevation of the object 5. Additionally, with the sensor array oriented parallel to the ground plane, a distant object 5 will produce hot spots in either the upper or lower quadrants of two or more focal planes, but not both upper and lower quadrants simultaneously. Thus, the search for corresponding hot spots can be constrained by common elevations. Thus, if only one uniquely moving object 5 exists, and it is successfully detected and segmented from the background by two or more cameras, then the pairs of coordinates will obviously uniquely identify its relative range, azimuth, and elevation. However, two or more objects could be segmented per camera with the examination of activity in the two hemi-fields of the focal plane. This is possible because over a short time history, no information is deleted. Instead, all information is updated with the accumulation of new data, preserved in buffers at successive stages in the processing, and prioritized through competition for forwarding to the next steps in the process. Processing to this point simplifies the correspondence problem, but does not yet solve it under all ambiguities. Additional procedures disclosed below provide a resolution of hot spot ambiguities and solve the correspondence problem for sources of motion in multiple focal planes.

Figure 6:
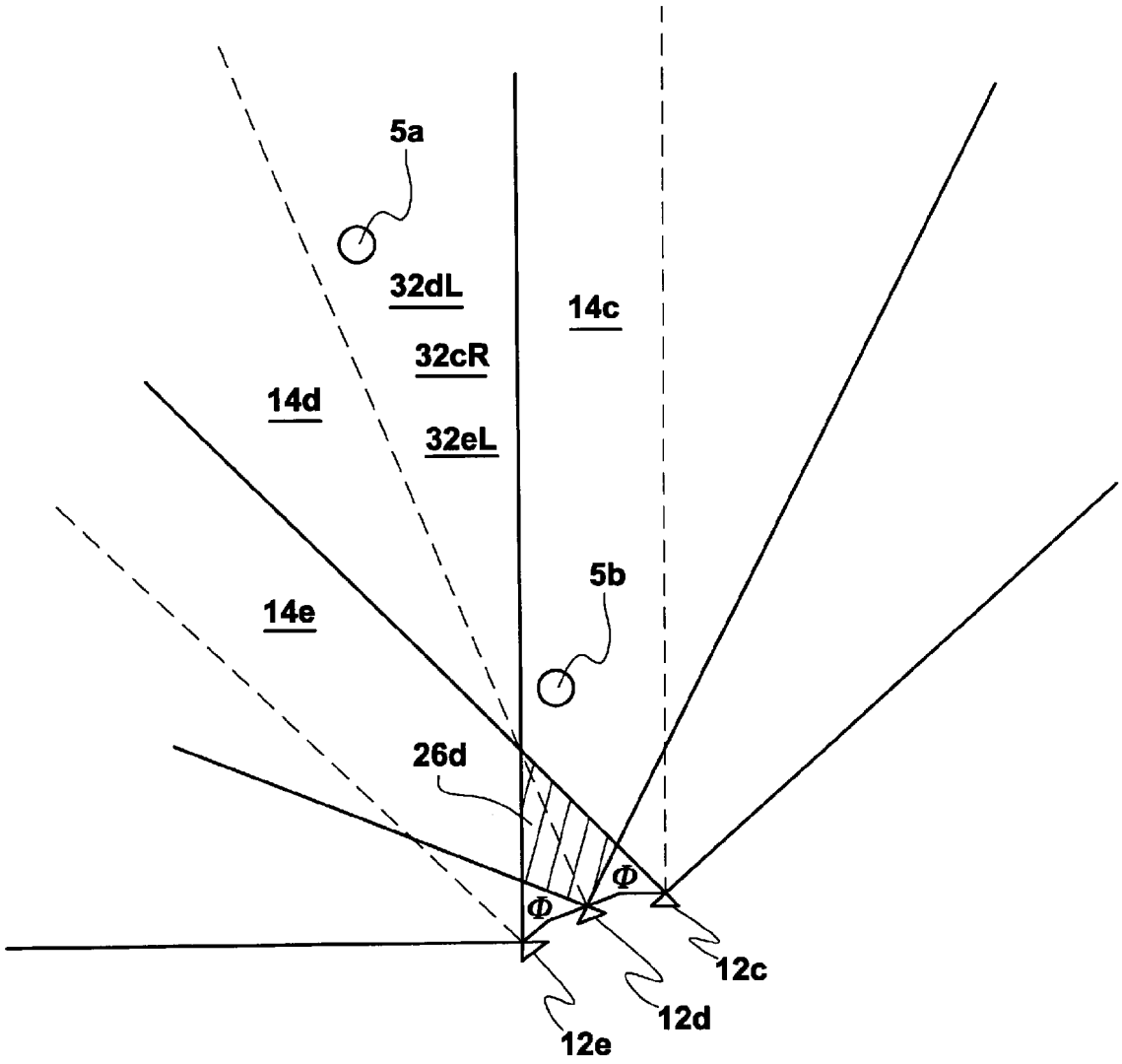
FIG. 6 illustrates how the horizontal field of view of the adjacent cameras shown in FIG. 3 is used to resolve range ambiguities of objects to yield object range and trajectory.

FIG. 6 shows the visual fields of the left focal planes (L), and the right focal planes (R) for three representative cameras 12*c*-12*e* from sensor array 1 of FIG. 2. As shown in FIG. 6, visual fields 14*c*, 14*d* and 14*e* are marked. Except for the small regions 26 that are detected by only one camera (region 26*d* is shown in FIG. 6), and the even smaller regions Φ that are not covered by any camera, all other regions are detected by the left focal planes of at least one camera and simultaneously the right focal plane of at least one other camera. For example, object 5*a* is located in the right visual hemi-fields of cameras 12*d* and 12*e* and thus project to their left focal planes 32*d*L and 32*e*L, respectively. At the same time, object 5*a* is located in the left visual hemi-field of camera 12*c* and thus projects to the right focal plane 32*c*R of camera 12*c*, as shown in FIG. 6 (note that left visual hemifields are inverted to corresponding right focal planes, and vice versa).

In the case where several or all focal planes each contain a hot spot, the search is more complicated, yet correspondence can be resolved with the following procedure. The procedure involves the formation of hypotheses of correspondences for pairs of hot spots in neighboring cameras and the testing against the observed data of the consequences of the those assumptions on the hot spots detected in the different focal planes. To do this, and referring now to FIG. 7, seven regions (labeled α, β, γ, ϵ, ϵ, ζ, and η, respectively, in FIG. 7) are defined in the visual space by their projections to a camera's hemi-focal plane. The regions are distinguished by range and azimuth relative to the hemi-focal plane and thus differ in the combinations of other camera hemi-focal planes to which a target located in the region would project.

Figure 7:
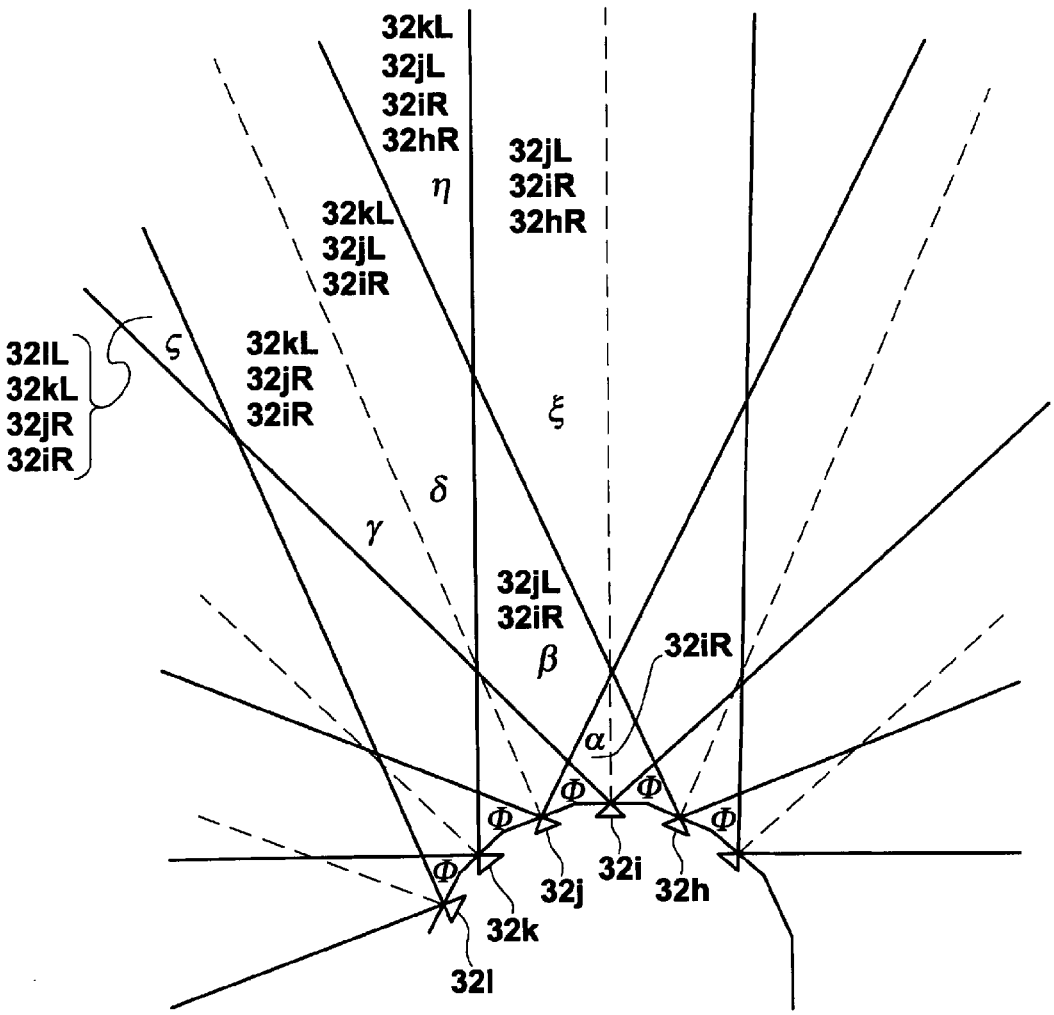
FIG. 7 shows the unique co-coverage of seven different regions of the visual space possible for one hemi-focal plane of one representative camera.

The regions α, β, γ, δ, ζ, and η labeled in FIG. 7 correspond to the right hemi-focal plane (left visual hemiplane) of camera 12*i* (all camera hemi-focal planes have a similar set of regions). Note that an object whose range and azimuth would place it only in region a would be detected only in the hemi-focal plane 321R of camera 12*i* and in a hemi-focal plane of no other camera. An object whose location is in the region δ would be detected in the hemi-focal planes 32*k*L, 32*j*L, 321R and no others. Thus, after calculations of range and azimuth by using data from hot spot detections in the hemi-focal planes 32*j*L and 321R place the object in region 6, and an additional hot spot should additionally be detected in 32*k*L only, from which the similar range and azimuth should be derived through calculations involving the hot spot.

A hypothesis of the location of a target in one of the seven regions is initially formed using data from two neighboring cameras. When the hypotheses are confirmed by finding required hot spot locations in correlated cameras, the correspondence is assigned, else the correspondence is negated and the hot spot is available for assignment to a different source location. In this way the process moves around the circle of hemi fields until all hot spots are assigned to a source location in the sensor field.

Referring back to FIG. 6 as a further example, object 5*b* is located in visual field 14*c* of camera 12*c*, and in the visual field 14*d* of camera 12*d*. Its calculated range and azimuth would place it in the visual field of no other cameras, thus no hypothesis would be made concerning its detection by a camera other than 12*c* and 12*d*. Object 5*a* is also located in the visual fields 14*d* of camera 12*d* and 14*e* of camera 12*e*. As there are no other hot spots evident in the right hemi-focal plane of camera 12*c*, an assumption of occlusion of 5*a* by 5*b* is justified. The range and azimuth of 5*a* can be calculated from the additional data of cameras 12*c* and 12*d* and the results would indicate that a hot spot should also be detected at a specific hemi-focal plane location in camera 12*e*. After confirmation of this hypothesis, object 5*a* can be triangulated and evaluated as a single target that is separate and distinct from object 5*b*. In this manner, all hot spots in the sensor field, are correlated to establish locations of objects 5 in the overall field of view (even those objects subject to partial occlusion, unless the object is located within a one camera region such as 26*d* or within the regions Φ in FIG. 6.

In summary, unique and salient sources of motion at common elevations on two hemi-focal planes from different cameras having overlapping receptive fields can be used to predict other hot spot detections. Confirmation of those predictions is used to establish the correspondences among the available data and uniquely localize sources in the visual field.

The process of calculating the azimuth of an object 5 relative to the host vehicle 4 from the locations of the object 5's projection on two neighboring hemi-focal planes can be accomplished by first recognizing that a secant line to the circle defined by the perimeter 28 of the sensor array will always be normal to a radius of the circle. The secant is the line connecting the locations of the focal plane centers of the two cameras used to triangulate the object 5. The tangent of the object 5 angle relative to any focal plane is the ratio of the camera-specific focal length and the location of the image on the plane (distance from the center on X and Y). The object 5 angle relative to the secant is the angle plus the offset of the focal plane relative to the secant. For a two-camera secant (baseline) (See baseline 16 of FIG. 2), this angle is 22.5/2 degrees; for a three-camera baseline secant (34 in FIG. 2) the angle is 22.5 degrees; while for a four-camera baseline (baseline 20 in FIG. 2) the offset angle is 33.75 degrees. Finally, the object 5 angle relative to the heading of the vehicle 4 center of the sensor array is given by the following equation:

Object 5 azimuth=(azimuth of center of focal plane#1+object 5 angle from focal plane#+azimuth of center of focal plane#2−object 5 angle from focal plane#2)/2 1[1]

The addition or subtraction of the above elements depends upon the assignment of relative azimuth values with rotation about the host. In one embodiment, angles can increase with counterclockwise rotation on the camera frame, with zero azimuth representing an object 5 directly in the path of the host vehicle.

Figure 8:
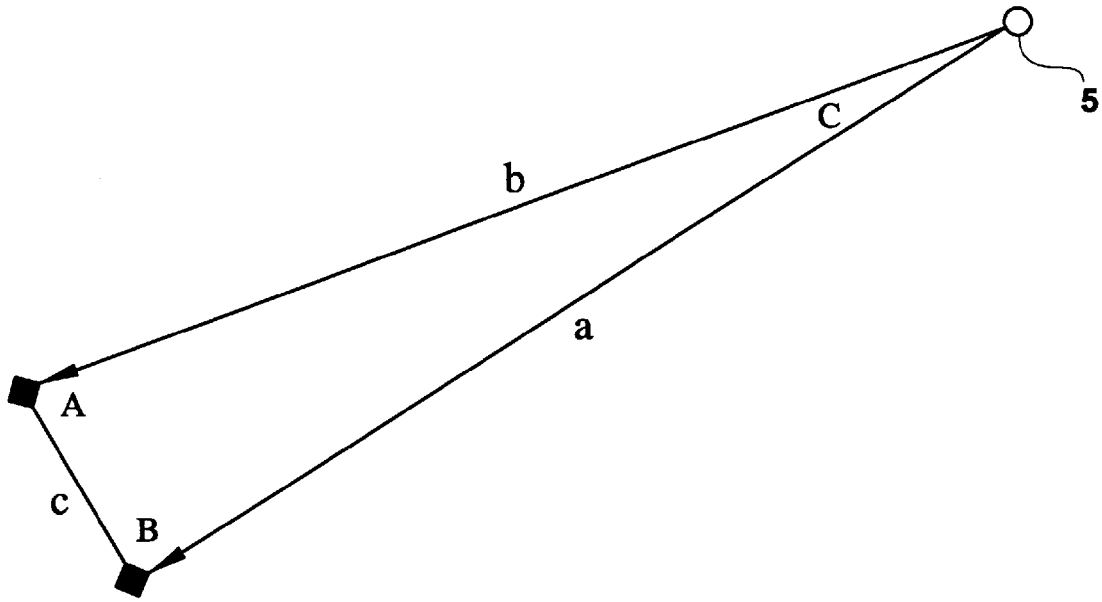
FIG. 8 shows one method of triangulation that can be used to determine target range from any pair of cameras with overlapping visual fields; and, FIG. 9 is a flow chart showing the steps of a method in accordance with an embodiment of the present invention.

Target range is a function of object 5 angles as derived above, and inter-focal plane distance, and may be triangulated as shown in FIG. 8. The information available from each pair of focal planes is angle-side-angle. The law of sines is useful here:

$$a=(c/\sin C)\sin A \text{ and } b=(c/\sin C)\sin B \quad [2]$$

where, c is the distance between the two focal plane centers;

A and B are the angles (in radians) to the object 5 that were derived from Equation [1], and C is π−(A+B); and, a and b are the distances to the object 5 from the two focal planes respectively.

The preferred object 5 range is the minimum of a and b. Target elevation will be a direct function of the Y location of the hot-spot on the image plane and range of the source.

Nearby objects necessarily pose the greatest collision risk. Therefore, first neighboring pairs of cameras for common sources of hot spots should be examined. For example, and referring to FIG. 6, given a hot spot in the right half of the focal plane 32*c*R of camera 12*c*, corresponding to an object located in the left visual field 14*c* of camera 12*c*, a projection should be expected in the left half of the focal plane 32*d*L of camera 14*d*, corresponding to an object located in the right visual field 14*d* of camera 12*d*. This is evident in the example of FIG. 6. Moreover, at greater distances, hot spots due to the same source should be expected in neighboring cameras more distant than adjacent cameras adjacent cameras 12*c* and 12*d* (such as the detection of object 5*a* by cameras 12*c* and 12*e* in FIG. 6). Optimal range and azimuth resolution will depend upon the selection of camera pairs that detect the same source and have the greatest camera separation. Because of the known geometry of the camera array, predictions can be made regarding the potential location of hot spots in subsequent neighboring cameras 12. These predictions are made by working backwards from the process involving equations [1] and [2] above.

In summary, the process of camera pair selection depicted involves the following steps. First, calculate range and azimuth of object 5 detected by immediate neighbor pairs of cameras 12. If range and azimuth from the immediate neighbor pairs indicate that the next lateral neighbor should detect object 5, repeat the calculation based on a new parings with the next later neighbor camera 12. This step should be repeated for subsequent lateral neighbor cameras 12 until no additional neighbor camera 12 sees object 5 at the anticipated azimuth and elevation. Finally, the location data for object 5 that was provided by the camera pairs with the greatest inter-camera distance is assigned by the central processor as the located data for the object 5.

Collision risk is determined using the same process as is described in U.S. patent application Ser. No. 12/144,019, for an invention by Michael Blackburn entitled "A Method for Determining Collision Risk for Collision Avoidance Systems", except that the data associated with the hot spots of the present subject matter are substituted for the data associated with the leading edges of the prior inventive subject matter.

The data provided by the above motion analysis and segmentation processes to the collision assessment algorithms include object range, azimuth, and motion on X, and motion on Y on the focal plane. The method of determining collision risk described in U.S. patent application Ser. No. 12/144,019 requires repeated measures on an object to assess change in range and azimuth. While the motion segmentation method above often results in repeated measures on the same object, it does not alone guarantee that repeated measures will be made sufficient to assess changes in range and azimuth. However, once an object's range, azimuth, and X/Y direction of travel have been determined by the above methods, the object may be tracked by the visual motion analysis system over repeated time samples to assess its changes in range and azimuth. This tracking is accomplished by using the X and Y motion information to predict the next locations on the focal planes of the hot spots on subsequent time samples and assess, if the predictions are verified by the new observations, the new range and azimuth parameters of the object without first undertaking the motion segmentation competition. With this additional information on sequential ranges and azimuths, the two inventive subject matters of U.S. patent application Ser. No. 12/144,019 and the present are compatible. If either RADAR or LIDAR and machine vision systems are available to the same host vehicle the processes may be performed with the different sources of data in parallel.

Figure 9:
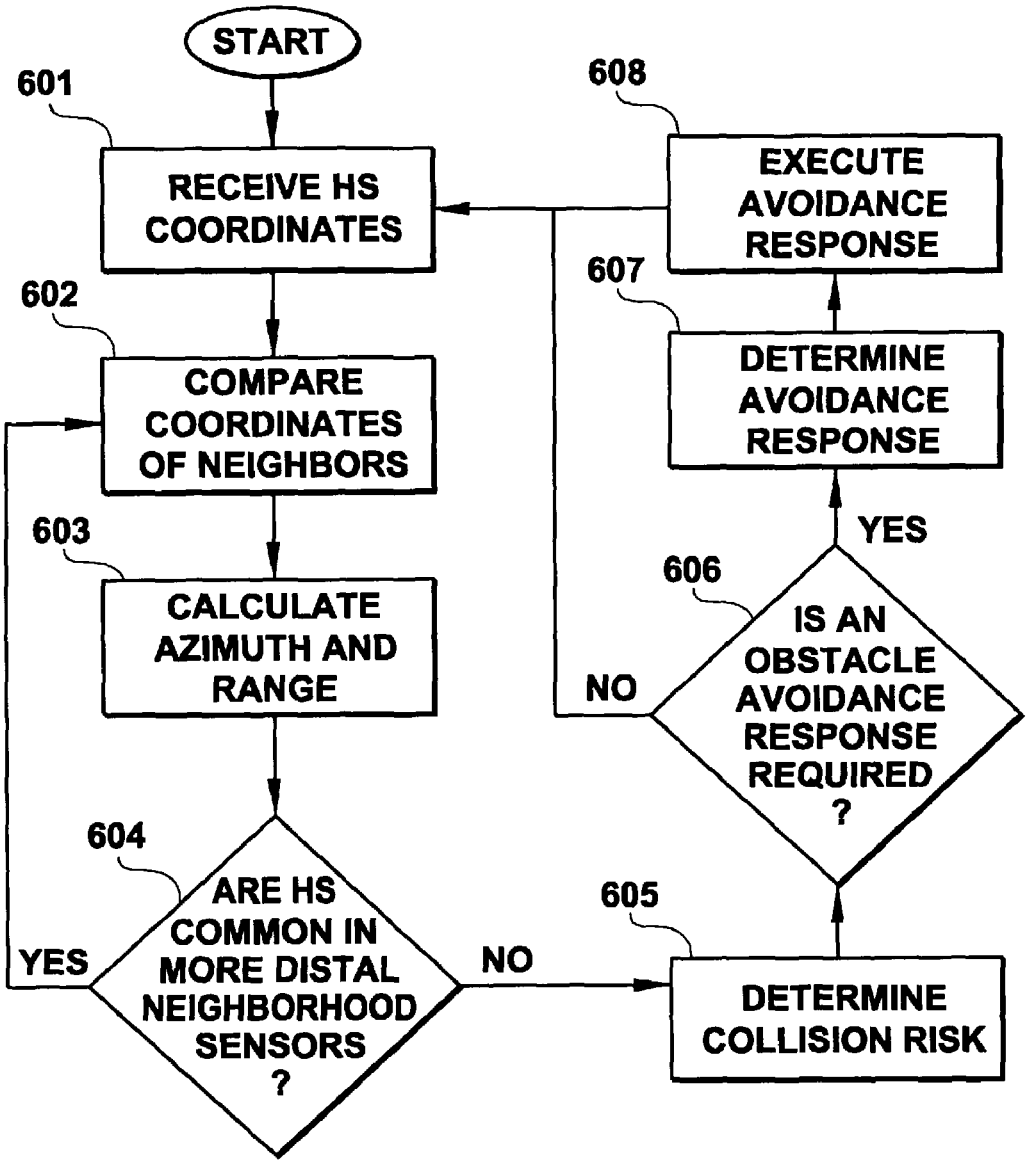

Generally, the method of the present subject matter is show in FIG. 9. A system using the present method receives hot spot (HS) coordinates at step 601, compares coordinates of neighboring cameras at step 602 and calculates azimuth and range data at step 603, as described above. At decision step 604, the system will determine whether the HS appears in cameras that are more distant from the first camera than the adjacent cameras. If so, the system will return to step 602 to compare the coordinates of the farther cameras with the original camera. If not, then the system will proceed to step 605 to determine the risk of collision. At decision step 606, the system will consider whether the collision risk is high enough to require an object avoidance response. If not, then the system returns to step 601. If so, then the system proceeds to step 607 and determines an object avoidance response. Last, at step 608, the system will cause a host vehicle to execute the collision avoidance response.

The advantage of assessing multiple camera pairs to find the greatest baseline is in the increased ability to assess range differences at long distances. For example, when the radius of the sensor frame is 0.75 meter, the inter-focal plane distance will be twenty-nine centimeters (29 cm). The distance between every second focal plane will be 57 cm, and the distance between every third focal plane will be eighty-three centimeters (83 cm), which is a significant baseline for range determination of distant objects.

An additional factor will be the resolution of the image sensors and the receptive field size required for motion segmentation. These quantities will determine the range and azimuth sensitivity and resolution of the process. Given an optical system collecting light from a 90 degree hFOV with a pixel row count of 1024, each degree of visual angle will be represented by approximately 11 pixels. The angular resolution will thus be 1/11 degree, or 5.5 arc minutes; with a 60 degree hFOV, and a pixel row count of 2048, the resolution is improved to 1.7 arc minutes.

The method of the present subject matter does not require cueing by another sensor system such as RADAR, SONAR, or LIDAR. It is self-contained. The method of self-cueing is related to the most relevant parameters of the object; its proximity and unique motion relative to host vehicle 4.

Due to motion parallax caused by self motion of the host vehicle, nearby objects will create greater optic flows than more distant objects. Thus a moving host on the ground plane that does not maintain a precise trajectory can induce transitory visual motion associated with other constantly moving objects, and thus assess their ranges, azimuths, elevations, and trajectories. This approach is a hybrid of passive and active vision. The random vibrations of the camera array may be sufficient to induce this motion while the host vehicle is moving, but, if, not then the frame itself may be jiggled electro-mechanically to induce optic flow. The most significant and salient locations of this induced optic flow will occur at sharp distance discontinuities, again causing nearby objects to stand out from the background.

The previous description of the disclosed embodiments is provided to enable any person skilled in the art to make or use the present inventive subject matter. Various modifications to these embodiments will be readily apparent to those skilled in the art, and the generic principles defined herein may be applied to other embodiments without departing from the spirit or scope of the inventive subject matter. For example, one or more elements can be rearranged and/or combined, or additional elements may be added. Thus, the present inventive subject matter is not intended to be limited to the embodiments shown herein but is to be accorded the widest scope consistent with the principles and novel features disclosed herein.

It will be understood that many additional changes in the details, materials, steps and arrangement of parts, which have been herein described and illustrated to explain the nature of the invention, may be made by those skilled in the art within the principal and scope of the invention as expressed in the appended claims.

What is claimed is:

1. A method of identifying and imaging a high risk collision object relative to a host vehicle comprising the steps of:

A) using N passive sensors to image a three-hundred and sixty degree view from said host vehicle, each of said N passive sensors having a corresponding horizontal field of view (hFOV), each said hFOV from one of said N passive sensors overlapping at least one of said hFOVs from another of said N passive sensors;

B) comparing contrast differences in the hFOVs to identify a unique source of motion (hotspot) that is indicative of said object;

C) correlating a first hot spot in said hFOV of one of said N passive sensors to a second hot spot in all other said N passive sensors that have overlapping said hFOVs with said one of said N passive sensors to yield a range, azimuth and trajectory data for said object;

D) sequentially repeating said steps B) and C) at predetermined time intervals to yield changes in said range and azimuth data of the detected hot spot; and, E) assessing collision risk of said host vehicle with said object according to said changes in said range and azimuth data from said step D).

2. The method of claim 1 wherein said step A) is accomplished using said N passive sensors that have a horizontal field of view (hFOV) of 360/N degrees, said step A) being further accomplished by placing said N passive sensors in a circular arrangement and radially equiangular from each other.

3. The method of claim 2 wherein said N passive sensors are visible light cameras.

4. The method of claim 2 wherein said N passive sensors are infrared (IR) cameras.

5. The method of claim 1 wherein said step A) is accomplished with said hFOV's that overlap.

6. The method of claim 1 wherein said step A) is accomplished with said N passive sensors that have a vertical field of view (vFOV), and further wherein said vFOVs establish a minimum range detection for said object.

7. The method of claim 1 wherein said step C) is accomplished with one of said N passive sensors, wherein said step D) is accomplished with another of said N passive sensors that is adjacent to said one of said passive N sensors from said step C).

8. The method of claim 1 wherein said second sensor from said step D) is accomplished using at least two of said N passive sensors that are not adjacent to each other.

9. The method of claim 1 further comprising the step of:

F) calculating a collision response for said host vehicle when said collision risk from said step E) is above a predetermined level.

10. A method of avoiding a collision with a object comprising the steps of:

A) arranging a plurality of N passive sensors on a host vehicle, each said N passive sensor having a horizontal field of view (hFOV), said plurality of N passive sensors collectively attaining a three hundred and sixty degree hFOV from said host vehicle;

B) detecting said object in a first hFOV from one of said N passive sensors;

C) sensing said object in a second hFOV from another of said N passive sensors; said second hFOV cooperating with said first hFOV to establish an overlapping region, said object being located in said overlapping region;

D) correlating said first hFOV and said second hFOV with a central processor to calculate azimuth, range and trajectory data for said remote object relative to said vehicle; and, E) determining collision risk of said host vehicle with said remote object according to said data.

11. The method of claim 10 further comprising the step of:

F) determining a collision avoidance response when said collision risk is above a predetermined level.

12. An apparatus for automatic omni-directional collision avoidance comprising:

a plurality of N passive sensors mounted on a vehicle;

each of said N passive sensors having a horizontal field of view (hFOV), each said hFOV from one of said N passive sensors overlapping at least one of said hFOVs of another of said N passive sensors, said plurality of N passive sensors being mounted to said vehicle to establish a three-hundred and sixty degree horizontal field of view (hFOV);

said of said N passive sensors comparing contrast differences in its respective said hFOV to identify a unique sources of motion (hot spots) that are indicative of the presence of an object in said hFOV;

a means for processing said hot spots by to assess collision risk of said vehicle with said object according to said data; and, said processing means correlating a first said hot spot in said first hFOV of one said N passive sensors to at least one other said hot spot in at least other of said hFOVs of said another of said N passive sensors to yield a range, azimuth and trajectory data for said object.

13. The apparatus of claim 12 wherein said means for processing comprises:

a plurality of N image processors, each said image processor being operatively coupled to a respective said N passive sensor for determining said hot spots in said hFOVs; and, a central processor for receiving inputs from said N image processors to yield said data.

* * * * *